United States Patent [19]

Koiso

[11] Patent Number: 5,021,830

[45] Date of Patent: Jun. 4, 1991

[54] ELECTROSTATIC RECORDING APPARATUS

[75] Inventor: Jun-ichi Koiso, Tokyo, Japan

[73] Assignee: Konica Corporation, Tokyo, Japan

[21] Appl. No.: 469,023

[22] Filed: Jan. 23, 1990

[30] Foreign Application Priority Data

Jan. 24, 1989 [JP] Japan ..... 1-7109[U]

[51] Int. Cl.[5] ..... G03G 21/00

[52] U.S. Cl. ..... 355/215; 355/298

[58] Field of Search ..... 355/215, 245, 296, 298–301; 118/653

[56] References Cited

U.S. PATENT DOCUMENTS 3,635,196 1/1972 Tsilibes ..... 118/653

4,040,386 8/1977 Smith ..... 118/653

FOREIGN PATENT DOCUMENTS 59-34580 2/1984 Japan .

59-151266 10/1984 Japan .

*Primary Examiner*—George H. Miller, Jr.

*Attorney, Agent, or Firm*—Finnegan, Henderson, Farabow, Garrett, and Dunner

[57] ABSTRACT

An electrostatic recording apparatus having a cleaning device and/or a developing device, in which a container is provided and a seal member is mounted on the container. The seal member is inserted in a groove formed in the circumferential surface of an end portion of a photosensitive drum.

11 Claims, 3 Drawing Sheets

ELECTROSTATIC RECORDING APPARATUS

BACKGROUND OF THE INVENTION

1. Field of the Invention

This invention relates to an electrostatic recording apparatus in which a toner image formed on a photosensitive drum by a developing device is removed by a cleaning device after the toner image is transferred to recording paper.

2. Description of the Prior Art

A cleaning device in an electrostatic recording apparatus is adapted to scrape off by a blade the residual toner from the surface of a photosensitive drum after an electrostatic latent image formed on the drum is developed to a toner image by a developing device and transferred as a visible image onto recording paper, and introduce the scraped toner into a toner recovery vessel by a toner guide member positioned below the blade.

A container body in the cleaning device is disposed so as to face the circumferential surface of the photosensitive drum with a slight clearance kept, of course, between the container body and the surface of the drum, which is a rotary body.

The blade and toner guide member held in the container body are fixed so that they are also spaced slightly from the inner side surface of the container body for the purpose of keeping the blade and toner guide member in close contact with the drum surface and permitting the drum surface to slide on the contact portions of these parts smoothly at all times.

Therefore, especially, in the position close to the inner side surface of the container body, a part of the toner scraped off by the blade or a part of the toner being sent to the toner recovery vessel by the toner guide member scatters and flows out from the clearance between the container body and the drum surface to soil the recording paper and the machine parts.

To solve this problem, Japanese Patent Laid-Open No. 59-34580 and Japanese Utility Model Laid-Open No. 59-151266 propose the provision of a seal member consisting of a resilient material in a predetermined portion of this kind of apparatus. However, such a seal member must be fixed in a predetermined position with a high accuracy, or it constitutes a large load with respect to the rotation of the drum and the movement of the blade. Consequently, this seal member lacks practicality.

Specifically, in the Japanese Patent Laid-Open No. 59-34580, a seal member 21 is arranged on the back side of a sheet-like guide member 22 and fixed to an end seal member 23, as shown in FIG. 4. In such construction, if the seal member 21 is not arranged with a high accuracy, the seal member 21 affects a cleaning blade 24 and the guide member 22 so that the cleaning of the residual toner becomes insufficient and toner is scattered to the outside of the container body.

Further, a portion of the seal member 21 which is fixed to the end seal member 23 shown in FIG. 5A is liable to be separated from the end seal member 23, as shown in FIG. 5B, thereby causing toner to be leaked.

In the Japanese Utility Model Laid-Open No. 59-151266, a seal member 21 is provided along the end portion of the photosensitive drum 25, as shown in FIG. 6.

In such construction, if the seal member 21 is not fixed to an end seal member 23 with a high accuracy, for example, if the seal member 21 is separated from the end portion of the photosensitive member 25 as shown in FIG. 7A, toner will be leaked from the clearance between the two. Alternatively, if the seal member 21 is in contact with the end portion of the photosensitive member 25 under a high pressure as shown in FIG. 7B, a large load will be applied to the photosensitive member 25, or under a low pressure as shown in FIG. 7C, toner will be leaked in the transverse direction between the seal member 21 and the photosensitive member 25.

SUMMARY OF THE INVENTION

An object of the present invention is to provide an improved electrostatic recording apparatus capable of solving these problems and provided with a cleaning device using a shielding member which has a low frictional resistance, and which can be fixed easily, whereby the scattering and outflow of the toner to the outside is effectively prevented.

This object is achieved by an electrostatic recording apparatus having a cleaning device and/or a developing device, wherein a container body is provided and a plate type projection having a seal member is mounted on said container body, said seal member being inserted in a groove formed in the circumferential surface of an end portion of a photosensitive drum.

The above and other objects as well as advantageous features of the invention will become apparent from the following description of the preferred embodiment taken in conjunction with the accompanying drawings.

DESCRIPTION OF THE PREFERRED EMBODIMENT

Figure 1:
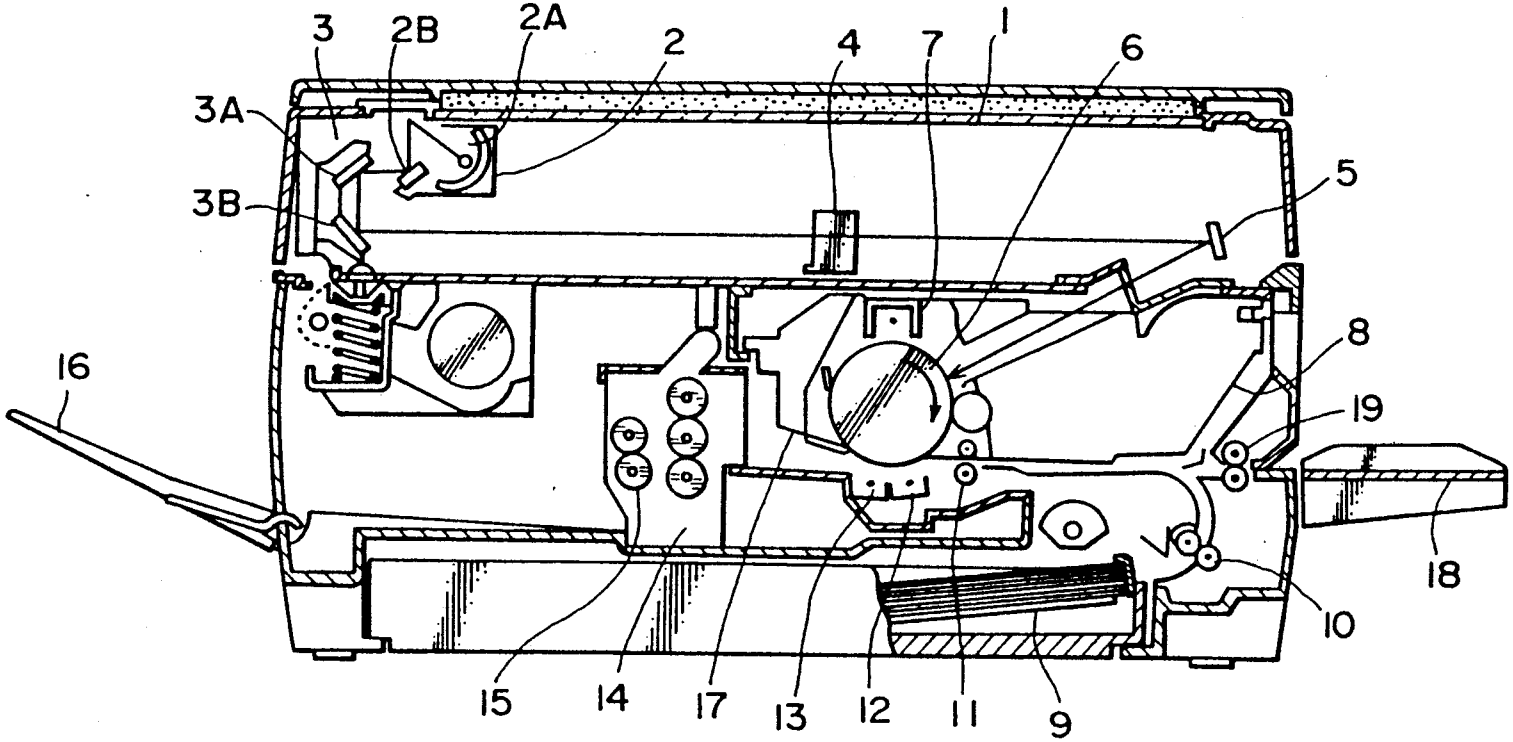
FIG. 1 is a sectional view of an electrostatic recording apparatus according to the present invention.
Figure 2:
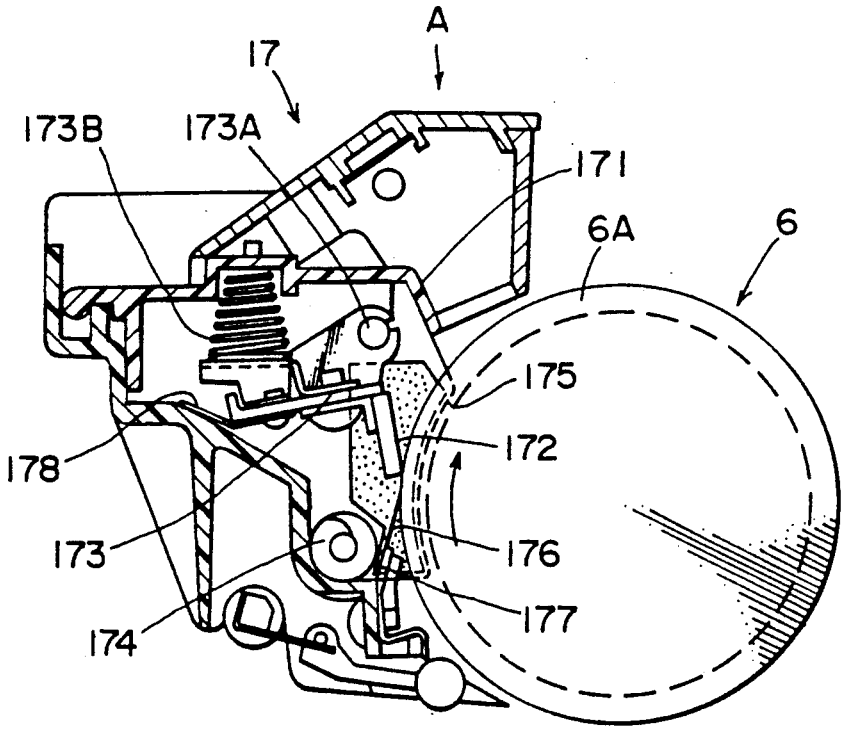
FIG. 2 is a sectional view of a cleaning device used in this apparatus.
Figure 3:
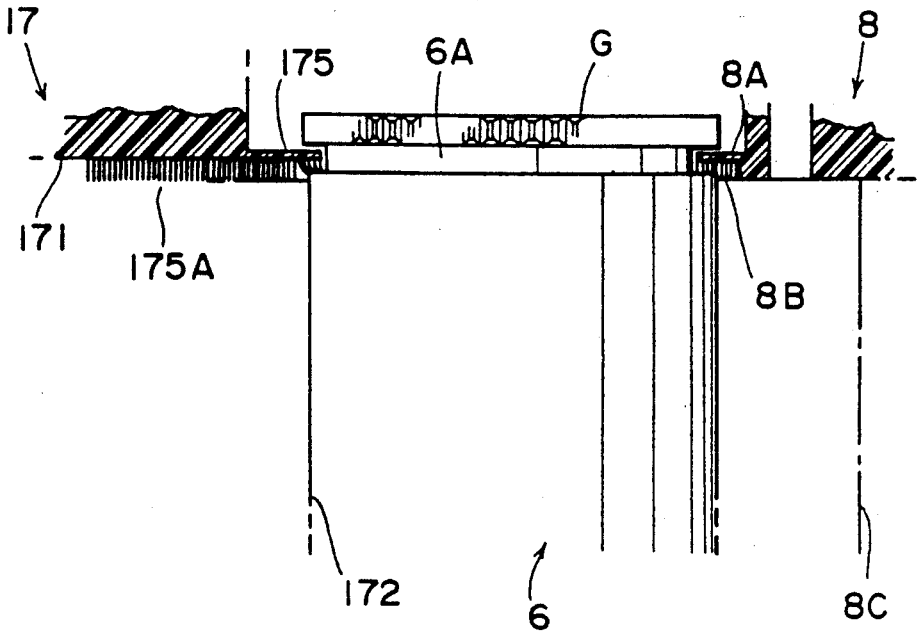
FIG. 3 is a plan view of a principal portion of the cleaning device.
Figure 4:
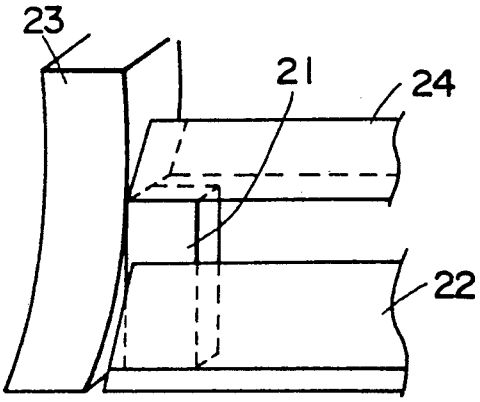
PRIOR ART FIG. 4
FIG. 4 is a sectional view of a sealing device of a conventional electrostatic recording apparatus.
Figure 6:
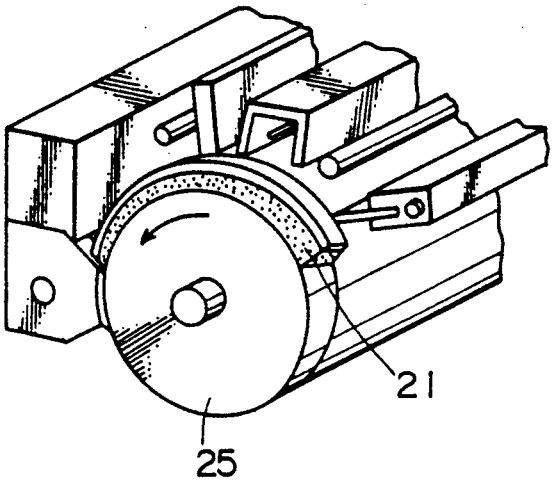
PRIOR ART FIG. 6
FIG. 6 is a perspective view of an other conventional electrostatic recording apparatus.
Figure 5A:
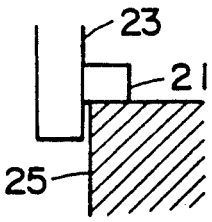
PRIOR ART FIG. 5A
FIGS. 5A and 5B are views explaining a seal member of the apparatus shown in FIG. 4, respectively.
Figure 5B:
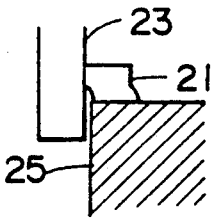
Figure 7A:
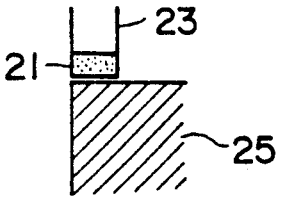
PRIOR ART FIG. 7A
FIGS. 7A to 7C are views explaining a seal member of the apparatus shown in FIG. 6, respectively.
Figure 7B:
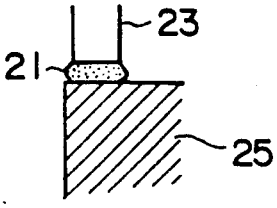
Figure 7C:
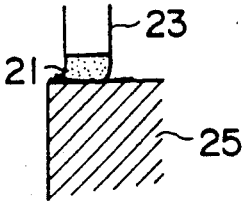

An embodiment of the present invention is shown in FIGS. 1-3. FIG. 1 is a schematic construction diagram of the electrostatic recording apparatus, in which the copying of a document is done as follows.

A document is placed on a document glass plate 1, and a copying button is pressed, so that the document surface is illuminated by an exposure lamp 2A provided on a horizontally slidable carriage 2. A movable mirror unit 3 has mirrors 3A, 3B, and is adapted to be slid horizontally at half the speed of the carriage 2. The image of the document is condensed by an image pickup lens 4 via a combination of the mirror unit 3 and a mirror 2B provided on the carriage 2, and a latent image is then formed on the circumferential surface of a photosensitive drum 6 via a fixed mirror 5, the exposure scanning of the document being thus carried out.

Since an electric charge is applied to the circumferential surface of the photosensitive drum 6 by a charging device 7 in advance, an electrostatic latent image of the document is formed thereon concurrently with the exposure operation mentioned above.

This electrostatic latent image is visualized by a developing device 8 in accordance with the rotation (in the direction of an arrow) of the photosensitive drum 6 to become a toner image, which is then transferred in a position above a transfer electrode 12 onto a recording paper fed from a paper feed cassette 9 toward this position via feed rollers 10, 11.

The recording paper onto which the toner image has been transferred leaves the circumferential surface of the drum due to an operation of a separating electrode 13, and enters a fixing device 14, in which the toner is melted and fixed. The resultant recording paper is discharged onto a paper discharge tray 16, which is provided on the outer side of the apparatus, via paper discharge rollers 15.

The photosensitive drum 6 from which the recording paper has been separated is subjected to the removal of the residual toner in a position opposed to a cleaning device 17, and then enters into a new image formation process in a subsequent cycle of rotation thereof.

A recording paper fed manually is sent from a paper feeding table 18 to the feed rollers 11 via manually inserted paper transfer rollers 19 and subjected to the transfer of an image through the same process as mentioned above.

FIG. 2 shows the detailed construction of the cleaning device 17. A reference numeral 171 denotes a container as a whole in the cleaning device 17, 172 a cleaning blade constituting a cleaning member, and 173 a blade holder to which the cleaning blade 172 is attached. The blade holder 173 is supported pivotably on front and rear fulcrum support shafts 173A fixed to the inner side surfaces of the container body 171, and it is urged counter-clockwise by the force of front and rear compression springs 173B. Owing to this arrangement, the cleaning blade 172 is engaged under pressure constantly at its lower edge portion with a load of a predetermined level with the circumferential surface of the photosensitive drum 6.

Reference numeral 174 denotes a toner transfer member provided at the bottom portion of the interior of the container body 171. The toner transfer member 174 is adapted to send the residual toner, which has been separated and dropped by the cleaning blade 172, to a toner vessel joined to the container body 171, by a force generated by the rotation of a helically threaded surface of the transfer, member 174.

Reference numeral 175 denotes a plate type projection formed on the side portion of the container body 171 which is opposed to the circumferential surface of the photosensitive drum 6. This projection 175 is inserted in a groove 6A provided in an end portion of the photosensitive drum 6, so as to form a barrier, whereby the scattering of the toner, which has been scraped off by the cleaning blade 172, to the outside of the container body is prevented.

Reference numeral 176 denotes a toner guide member consisting of a thin resilient plate formed by using, for example, a PET base, and 177 a guide holder supporting the toner guide member 176 and fixed to the part of the bottom portion of the container body 171 which is opposed to the circumferential surface of the drum 6. Owing to this arrangement, the upper edge portion of the guide member 176 is engaged at a low pressure with the portion of the circumferential surface of the drum 6 which is immediately below the portion of the same circumferential surface with which the blade 172 is pressure-engaged. Accordingly, the toner falling from the drum surface can be prevented from leaking from a clearance between the container body 171 and drum surface, and this toner is sent to and recovered by the toner transfer member 174 efficiently without being accumulated locally in the container body 171.

A flexible cover plate 178 provided on the blade holder 173 and pressure-engaged with the inner surface of the container body 171 prevents the residual toner, which has been scraped off from the drum surface, from scattering toward and entering the upper portion of the container body 171.

The details of the projection 175 will now be described with reference to FIG. 3 which shows a principal portion, which is viewed in the direction of an arrow A in FIG. 2, of the apparatus.

One side surface of the projection 175 has a seal member 175A bonded thereto, in which long soft hair of synthetic fiber is implanted, this seal member 175A having a sealing effect with respect to the end surface of the blade 172. The seal member 175A is also engaged slidably with the groove 6A provided between the end surface of the photosensitive drum 6 and a gear G mounted on the corresponding end portion of the shaft of the same drum, to further improve the effect of the projection 175 in shutting off the clearance between the container body 171 and the circumferential surface of the drum.

Consequently, the leakage of the toner from the clearance between the photosensitive drum 6 and container body 171 can be prevented substantially to perfection without practically imparting a rotational load to the drum 6. Accordingly, the gear G is kept clean at all times, and the power is thereby transmitted smoothly with a high efficiency.

Further, it goes without saying that it is effective to provide a similar seal means on the non-driven side.

Similarly, as shown by one-dot chain line, the developing device 8 is also provided at the side portion thereof which is opposed to the circumferential surface of the drum with a projection 8A and a seal member 8B bonded thereto. The projection 8A and seal member 8B are inserted slidably in the groove 6A, whereby the leakage of the developer, which scatters from a developing sleeve 8C during a developing operation, to the outside of the developing device 8 can be prevented.

The projections 175, 8A may also be made independently and attached to the container body of the apparatus, and they may also be provided at the left and right edge portions of the container body so as to form barriers at both end portions of the shaft of the photosensitive drum 6.

The present invention thus provides an electrostatic recording apparatus which is provided with developing and cleaning devices capable of preventing effectively by their simply formed seal members the leakage of toner to the outside of the container body during the development of a latent image and the removal of the residual toner from the photosensitive drum, and which is thereby capable of keeping the recording paper and the interior of the recording apparatus clean at all times and obtaining high-quality copied images.

What is claimed is:

1. An electrostatic recording apparatus comprising a cleaning device having a container, said container being provided with a seal member inserted in a groove formed in the circumferential surface of an end portion of a photosensitive drum.

2. The electrostatic recording apparatus according to claim 1, further comprising a developing device having a container, said container being provided with a seal member inserted in a groove formed in the circumferential surface of an end portion of a photosensitive drum.

3. An electrostatic recording apparatus comprising a developing device having a container, said container being provided with a seal member inserted in a groove formed in the circumferential surface of an end portion of a photosensitive drum.

4. An electrostatic recording apparatus comprising:

a drum including a circumferential surface and a groove formed in said circumferential surface at an end portion thereof;

a device for cleaning said drum, said cleaning device including a container; and a seal member for creating a seal between said drum and said container, said seal member being positioned on said container and disposed in said groove.

5. The electrostatic recording apparatus of claim 4 wherein the seal member includes elongated fibers which engage the drum.

6. The electrostatic recording apparatus of claim 4 further comprising a gear positioned at an end of said drum, said groove being positioned between an end surface of said drum and said gear.

7. The electrostatic recording apparatus of claim 4 further comprising a device for developing an image on said drum, said developing device including a second container, and a second seal member for creating a seal between said drum and said second container, said seal member being positioned on said second container and disposed in said groove.

8. The electrostatic recording apparatus of claim 7 wherein the second seal member includes elongated fibers which engage the drum.

9. An electrostatic recording apparatus comprising:

a drum having a circumferential surface and a groove formed in said circumferential surface at an end portion thereof;

a device for developing an image on said drum, said developing device including a container; and a seal member for creating a seal between said drum and said container, said seal member being positioned on said container and disposed in said groove.

10. The electrostatic recording apparatus of claim 9 further comprising a gear positioned at an end of said drum, said groove being positioned between an end surface of said drum and said gear.

11. The electrostatic recording apparatus of claim 9 wherein the seal member includes elongated fibers which engage the drum.

* * * * *